United States Patent [19]

Cortorillo

[11] 4,297,611

[45] Oct. 27, 1981

[54] CONTROL OF TUNGSTEN FILAMENT EROSION IN A HALOGEN LAMP

[75] Inventor: Salvatore F. Cortorillo, Parsippany, N.J.

[73] Assignee: Wagner Electric Corporation, Parsippany, N.J.

[21] Appl. No.: 81,270

[22] Filed: Oct. 2, 1979

[51] Int. Cl.[3] ..... H01K 1/50; H01K 1/18

[52] U.S. Cl. ..... 313/222; 313/316

[58] Field of Search ..... 313/222, 316, 353, 348, 313/240, 242

[56] References Cited

U.S. PATENT DOCUMENTS

| | | | |
|---|---|---|---|
| 2,072,788 | 3/1937 | Andrews | 313/316 X |
| 2,179,437 | 11/1939 | Socolofsky | 313/222 X |
| 3,211,943 | 10/1965 | Cardwell, Jr. | 313/222 X |
| 3,458,746 | 7/1969 | Hörster et al. | 313/242 X |
| 3,497,753 | 2/1970 | Huston, Jr. | 313/222 X |
| 3,522,470 | 8/1970 | Bonazoli et al. | 313/222 X |
| 3,588,564 | 6/1971 | Vetere | 313/222 X |
| 3,717,784 | 2/1973 | Matheson | 313/222 |

*Primary Examiner*—Palmer C. Demeo

*Attorney, Agent, or Firm*—Eyre, Mann, Lucas & Just

[57] ABSTRACT

The present invention is directed to an incandescent lamp having tungsten filaments and halogen gas in the lamp enclosure wherein an inoperative surrogate tungsten filament is incorporated to reduce the tendency for active halogen gas to attack the filament and other metal parts within the lamp enclosure.

11 Claims, 8 Drawing Figures

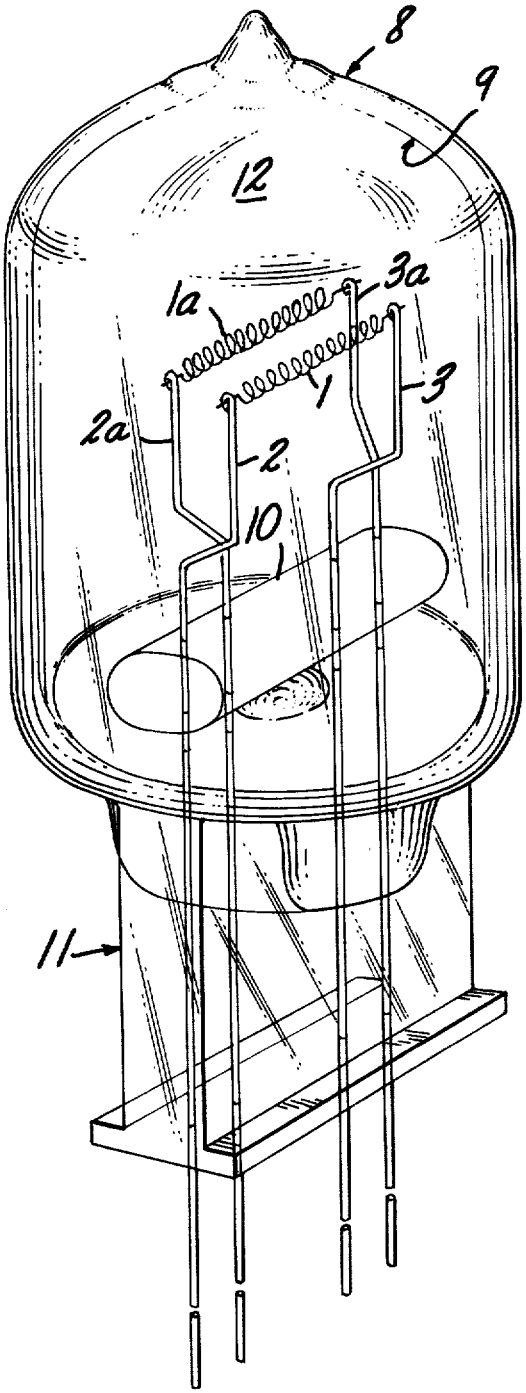
FIG. 1
(PRIOR ART)
FIG. 2
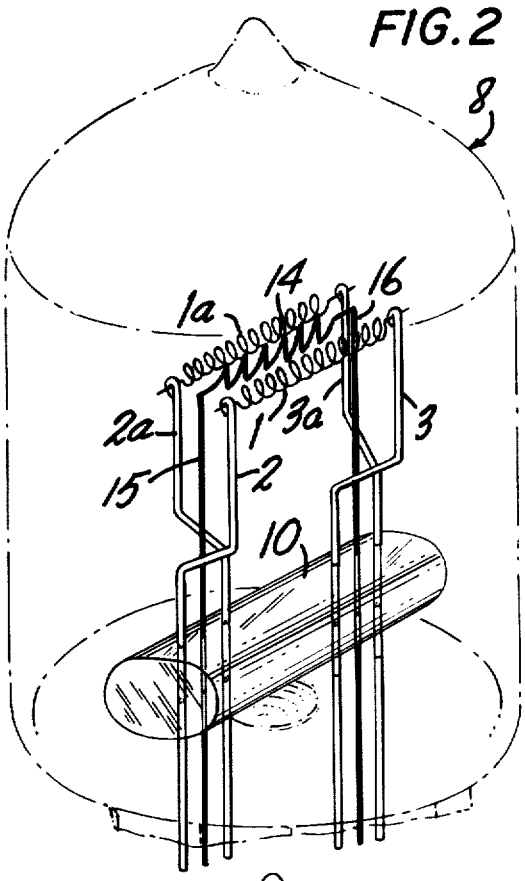
FIG. 3
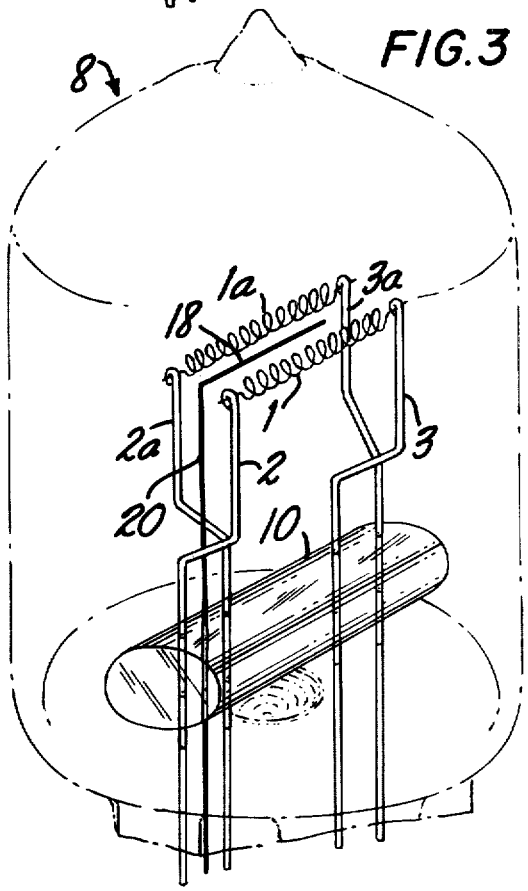

FIG. 6
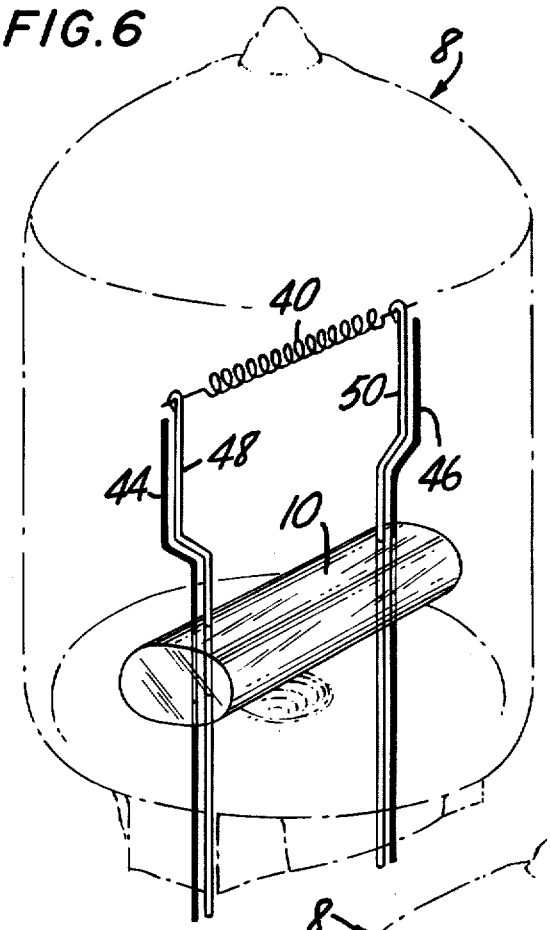
FIG. 7
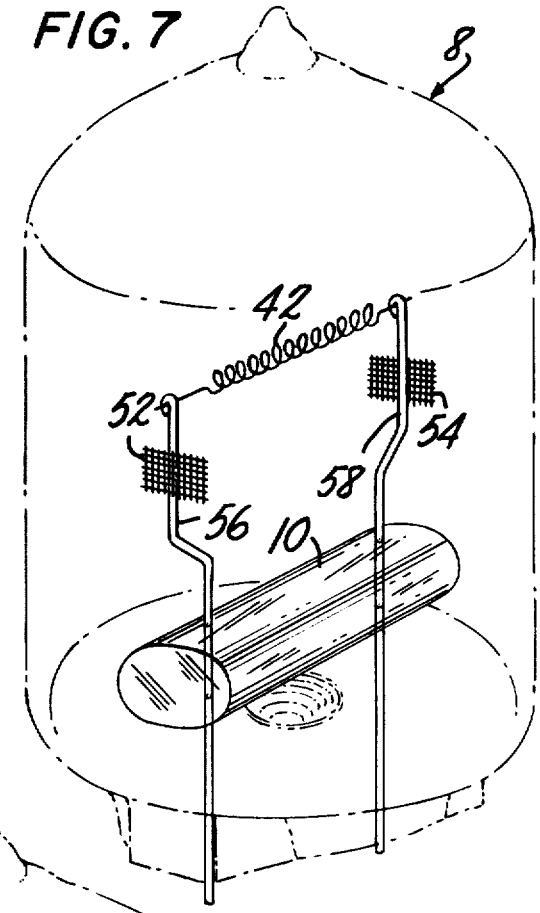
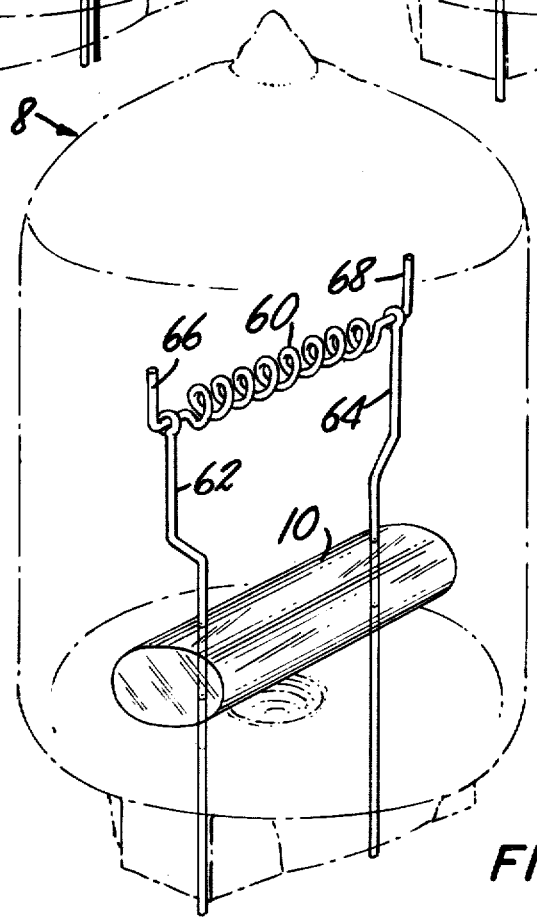
FIG. 8

CONTROL OF TUNGSTEN FILAMENT EROSION IN A HALOGEN LAMP

BACKGROUND OF THE INVENTION

The present invention relates to an incandescent lamp having tungsten filaments disposed in a bulb in which a halogen gas has been incorporated.

When tungsten filaments in incandescent lamps are heated to a temperature sufficient for the production of light tungsten sublimates from the filaments, the sublimated tungsten either remains suspended in the enclosed atmosphere of the lamp or is deposited on some other surface within the bulb. In small bulbs, the surface would normally blacken from the deposit of this sublimated tungsten. This blackening occurs so rapidly that the bulb would be of no practical use within a very short time.

It has been known for quite some time that the blackening of the bulb walls can be substantially reduced by adding a halogen to a standard inert atmosphere within the bulb, which may be any one or a mixture of inert gases such as argon, nitrogen, xenon, krypton, etc. With the halogen present, a minimum temperature on the order of 250° C. or greater at the wall of the bulb will promote a reaction between the tungsten deposited on the wall and the halogen in the atmosphere. The resulting tungsten-halogen gas molecule eventually returns to the area of the filament. Because of the filament's high temperature, of the order of 1800° C. to 2500° C., the energy available to the molecule is sufficient to dissociate the tungsten-halogen molecule. Tungsten is redeposited on the filament and the halogen atom is released to repeat the process again. Thus, the highly desirable result of tungsten metal being removed from the walls of the bulb and returned to the filament from which it sublimated is obtained.

It has been found, however, that while the tungsten filament is being constantly benefited through the regenerative cycle, other metal parts in this atmosphere, including filament support legs and the like, are being attacked by the active halogen atoms in the same manner as the metal on the walls. And, since these other metal parts are not heated to the degree the filament is, there is no corresponding replacement of metal as occurs at the filament. This causes a weakening of such metal parts and considerably shortens the life of the bulb. Attempts have been made to ameliorate this undesirable result. For instance, U.S. Pat. No. 3,538,373 discloses the use of a carbon film on all metal parts in the bulb except for the filament to shield the metallic surface from attack by the halogen. U.S. Pat. No. 3,431,448 teaches the reduction of the attack on a filament by configuring the filament and/or supports in a manner to avoid a sharp temperature gradient in the filament wire. In U.S. Pat. No. 3,431,448 the sharp gradient is avoided either by increasing the pitch of the filament coil or by configuring the supports to act as a "heat sink" of gradually increasing efficiency.

For small halogen lamps of the type suitable for use in car headlamps, the filaments may be relatively small. Stretching the filament coil in a manner disclosed in U.S. Pat. No. 3,431,448 produces an unacceptable loss in efficiency, and in many bulbs there is simply no room in which to expand the extra filament length. Special heat-sinking supports are significantly more expensive to produce than the conventional wire supports.

The use of a coating may be highly desirable in numerous instances, but it is impossible to protect a second operating filament using this teaching. The high temperature of an operating filament simply vaporizes any coating which is applied. Also, with two filaments, one of which is non-operating during the time when the other filament is operating, each may be subject to an accelerated attack by the halogens because of their proximity to each other and because the non-operating filament is likely to be in the path of the convection of the highly activated halogen atoms being returned to the enclosed atmosphere from the operating filament.

It has now been discovered that an inoperative surrogate element positioned within the bulb will lessen the severity of the attack on the filament or other metal parts within the bulb. Furthermore, the use of such a surrogate element is not limited to such two-filament bulb and may be incorporated into single filament bulbs as well. The present invention is particularly important to the life of "halogen lamps" in which the filaments operate in an atmosphere that contains a halogen gas or a combined form of a halogen gas such as hydrogen bromide, methyl bromide or chloride carbon tetrabromide, etc. The term "halogen gas" used in the specification and claims is intended to mean halogen gas per se and those other gases in which halogen is present in a combined form as is conventional in the art for halogen lamps.

SUMMARY OF THE INVENTION

The invention herein disclosed is a means to materially reduce the severity of the attack on the tungsten filaments or other metal elements in a halogen lamp. A surrogate tungsten element is incorporated into the lamp. The surrogate tungsten element is preferably made of tungsten or of some other metal having a surface coating of tungsten and if desired alloys of tungsten may be used provided that the selected alloy will attract the activated halogen gas in accordance with the present invention. The surrogate tungsten element preferably comprises one or more tungsten filaments and it is inoperative in that it does not provide any visible light and for best results the surrogate element does not receive any electric current. It may be placed in any portion of the enclosed volume of the bulb to provide a relatively larger surface area for the attraction of the activated halogen than that provided by the filament and/or support legs. In the preferred embodiments, the surrogate element is placed between the filaments in a two-filament lamp in order to partially screen the non-operating filament from the operating filament. These and other aspects of the present invention may be more fully understood with respect to the drawings in which:

FIG. 1 shows a two-filament halogen lamp of the prior art.

FIG. 2 is a fragmentary detail of the lamp of FIG. 1 showing the incorporation of an inoperative surrogate filament between the two operative filaments in one embodiment of the invention.

FIG. 3 is a fragmentary detail of FIG. 1 showing a second embodiment of the invention.

FIGS. 6 and 7 illustrate use of the surrogate element of the present invention with respect to a single operative filament of an incandescent lamp.

FIG. 8 illustrates another embodiment of the present invention with respect to a single operative filament of an incandescent lamp.

Figure 4:
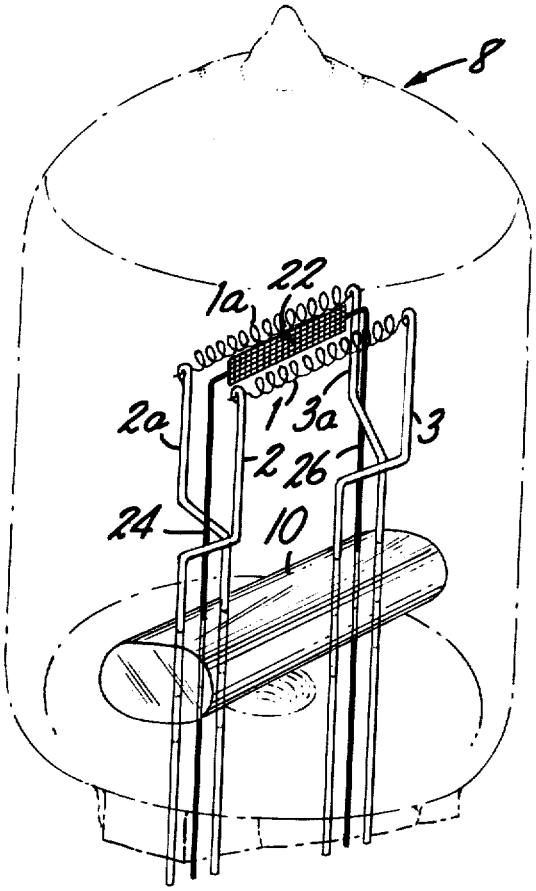
FIG. 4 is a fragmentary detail of FIG. 1 showing a third embodiment of the invention.

Referring now to FIG. 1 of the drawing, the prior art halogen lamp illustrated therein comprises a bulb 8 of high-melting-point transparent material within which conventional operative tungsten filaments 1 and 1*a* are supported on current carrying filament support legs 2, 2*a*, 3 and 3*a*. These support legs of tungsten or other similar metal are separated and supported by a bridge 10 and pass through a pinch 11 of bulb 8 into which the support legs are sealed, creating thereby an enclosed region 12 which is filled and sealed in a conventional manner.

A quantity of halogen gas sufficient for regenerative gettering of the filament is included in an otherwise inert atmosphere of argon, nitrogen, xenon, krypton or mixtures thereof within the enclosure 12.

The filaments 1 and 1*a* are connected through the current carrying support legs to a source of electricity not shown. Normally the filaments will not operate simultaneously.

The heat and radiant energy of the operating filament maintain the surface 9 of the bulb 8 at a temperature which will promote the formation of tungsten-halogen gas molecules. These molecules, formed at the wall, return by convection to the region of the operating filament 1 or 1*a*, where they are dissociated by the energy available at the operating filament. The tungsten from the tungsten-halogen molecule is redeposited on the operating filament and the halogen atoms which were bound in the tungsten-halogen molecule are freed.

The non-operating filament, placed as it is in close proximity to the operating filament, is within the convection path of the halogen atoms returning to the vicinity of the surface 9. The active halogen atoms in this convection current make no distinction between the tungsten deposited on the surface 9 and the tungsten of the non-operating filament and the support legs. Within a period of time, the support legs or the non-operating filament within this convection current may be weakened to the point that useful lamp life is ended.

FIG. 2 illustrates in fragmentary detail the two filaments of the prior art lamp. In accordance with the present invention, an inoperative surrogate filament 14 is shown mounted on support legs 15, 16. The filament is formed in a saw tooth shape to provide a screen between the two operative filaments 1 and 1*a*. The inoperative surrogate filament thus formed provides a means for shielding the non-operating filament whereby the activated halogen atoms created in the vicinity of the operating filament are inhibited from attacking the non-operating filament. The surrogate filament is shaped as a saw tooth in order to provide a greater surface area for screening the halogen atoms which would normally strike the non-operating filament. The inoperative surrogate filament is shown in a position substantially between the two operating filaments. But if other constraints dictate it, the inoperative filament may be placed either above or below the operative filaments.

Referring now to FIG. 3, another embodiment of the inoperative surrogate filament is shown wherein a tungsten wire comprising a surrogate filament 18 is supported by tungsten support leg 20 in a position substantially between the two operative filaments 1 and 1*a*. The tungsten wire 18 and support leg 20 may be one continuous tungsten wire. The surrogate inoperative filament 18 may also be placed either above or below the operative filament if other constraints dictate.

FIG. 4 shows another embodiment of the inoperative surrogate filament which is in the form of a tungsten screen 22 mounted between the operative filaments 1 and 1*a* by support legs 24, 26. The surrogate filament as shown provides maximum protection for the inoperative filament, but at a sacrifice in the optical quality of the lamp because of the shadow produced by the screen.

Figure 5:
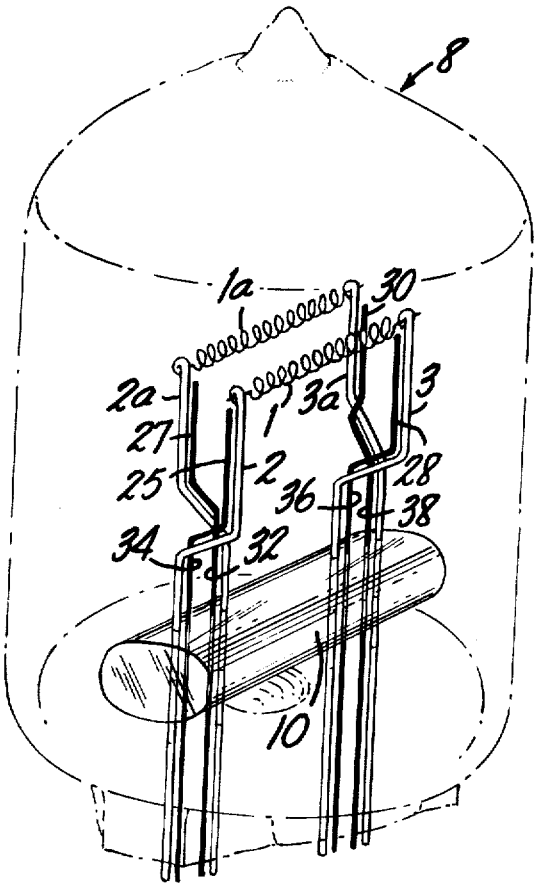
FIG. 5 is a fragmentary detail of FIG. 1 illustrating another embodiment of the present invention.

FIG. 5 illustrates use of four surrogate tungsten wire filaments 24, 26, 28 and 30 mounted below the operative tungsten filaments 1, 1*a* on support legs 32, 34, 36 and 38 respectively. FIGS. 6 and 7 illustrate use of surrogate tungsten filaments of the present invention in connection with lamps having a single operative tungsten filament 40 and 42 respectively. It is not deemed necessary to show any details of the lamp enclosure or filament mounts which are conventional and well known in the art. In the embodiment of FIG. 6 a pair of surrogate wire filaments 44 and 46 are positioned on opposite sides below the operative filament 40 and adjacent the operative filament support legs 48, 50. In the embodiment of FIG. 7 the surrogate filaments are in the form of tungsten screens 52, 54 mounted on the support legs 56, 58 for the operative filament 42. A single surrogate filament may be employed with some advantage but best results are achieved by using a pair of surrogate filaments which are preferably mounted on supports that do not carry current.

FIG. 8 illustrates a single operative tungsten filament 60 mounted in conventional manner on the lamp lead support legs 62 and 64. Details of the lamp enclosure and mount for the leads is not shown since these are conventional and well-known in the art. In this further embodiment of the invention the inoperative tungsten surrogate element comprises an extension of the lamp filament 66 which projects up above the operative filament 60 at one side thereof. For best results, a second inoperative surrogate element 68 which is also an extension of the operative filament 60 is positioned to project up above the second side of the operative filament.

One of ordinary skill in the art will appreciate that the inoperative surrogate tungsten elements illustrated in FIGS. 6 through 8 may be employed in lamps that have two or more tungsten filaments and for best results both of the filaments are provided with inoperative tungsten surrogate elements as illustrated in the drawings. It is not necessary to use the same type of surrogate element for each filament and for each support leg. Any one of the surrogate elements illustrated in the drawings may be combined with any of the other surrogate elements in a single lamp enclosure having a single or two or more operative filaments. In all cases the lamp enclosure will contain halogen gas or a mixture of halogen gas with other inert gases as is conventional in the art. The surrogate element in all cases reduces the attack of activated halogens on the operative filament or other metal parts.

It will be understood that the claims herein are intended to cover all changes and modifications of the preferred embodiment of the invention, herein chosen for the purpose of illustration, which do not constitute departure from the spirit and scope of this invention.

What is claimed is:

1. In an incandescent lamp of the type having at least two operative tungsten filaments in a bulb enclosing an atmosphere containing a halogen gas, the improvement comprising an inoperative surrogate filament within said bulb comprising a tungsten surface positioned in a region near said tungsten filaments to passively receive chemical attack by said halogen gas whereby said operative tungsten filaments are at least partially protected from attack by said halogen gas and wherein said operative tungsten filaments have two support legs each, said inoperative surrogate filament comprises four tungsten wires, one each positioned near a support leg, each said tungsten wire separated a small distance from said support leg and extending substantially parallel to its associated support leg.

2. An incandescent lamp comprising:

(a) a lamp enclosure enclosing therein a halogen gas;

(b) two selectably operative tungsten filaments disposed within said enclosure;

(c) each operative tungsten filament having at least one support leg for support within said enclosure;

(d) an inoperative surrogate element in said enclosure for passively receiving chemical attack by said halogen gas;

(e) said inoperative surrogate element comprising a plurality of tungsten elements, one each said tungsten element being disposed, respectively, in close proximity to each said support leg but not in contact therewith.

3. The incandescent lamp of claim 2 wherein said tungsten elements are tungsten wires.

4. The incandescent lamp of claim 3 wherein each said tungsten wire is parallel to and slightly separated from its associated support leg substantially along the entire length of the support leg.

5. A method for protecting tungsten parts within a lamp enclosure of an incandescent lamp having two operative tungsten filaments and a halogen gas therein comprising the step of positioning an inoperative surrogate element having an exposed tungsten surface within the lamp enclosure, said tungsten surface being adapted to remain below the temperature at which it will emit visible light during operation of the lamp.

6. A method for protecting a non-operating filament of a pair of selectably operating tungsten filaments in a lamp enclosure having a halogen gas therein comprising the step of positioning an inoperative surrogate element having an exposed tungsten surface in the proximity of the selectably operating filaments, said exposed tungsten surface being adapted to remain below the temperature at which it will emit visible light during operation of the lamp.

7. The method of claim 6 wherein the surrogate element is positioned parallel to the pair of tungsten filaments.

8. The method of claim 7 wherein the surrogate element is positioned between the operative tungsten filaments.

9. The method of claim 8 wherein the surrogate element is a tungsten wire.

10. The method of claim 9 wherein the tungsten wire portion between the operative tungsten elements is formed in the shape of a sawtooth.

11. The method of claim 7 wherein the surrogate element is a tungsten screen.

* * * * *